US006388397B1

(12) United States Patent
Iwahori

(10) Patent No.: US 6,388,397 B1
(45) Date of Patent: May 14, 2002

(54) DISCHARGE LAMP LIGHTING DEVICE

(75) Inventor: Yutaka Iwahori, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/553,049

(22) Filed: Apr. 20, 2000

(51) Int. Cl.[7] ..... H05B 41/36

(52) U.S. Cl. ..... 315/307; 315/224; 315/291; 315/DIG. 5

(58) Field of Search ..... 215/291, 307, 215/360, 362, DIG. 5, DIG. 7, 209 R, 224

(56) References Cited

U.S. PATENT DOCUMENTS 5,140,229 A * 8/1992 Yagi et al. ..... 315/307
5,142,203 A * 8/1992 Oda et al. ..... 315/224
5,212,428 A * 5/1993 Sasaki et al. ..... 315/307
5,266,869 A * 11/1993 Usami ..... 315/291
5,493,180 A * 2/1996 Bezdon et al. ..... 315/307
5,677,602 A * 10/1997 Paul et al. ..... 315/307
6,181,084 B1 * 1/2001 Lau ..... 315/291

* cited by examiner

*Primary Examiner*—Don Wong
*Assistant Examiner*—Thuy Vinh Tran
(74) *Attorney, Agent, or Firm*—Burns, Doane, Swecker & Mathis, LLP

(57) ABSTRACT

A discharge lamp lighting device includes first power converting circuit converting an input source voltage into another DC voltage, second power converting circuit constituted by a buck converter, and a discharge lamp as a load driven by an output of the second power converting circuit. The device being so controlled that a switching element in the second power converting circuit will be turned ON when the voltage across the switching element is the minimality. Wherein a unit is provided for regulating an output voltage of the first power converting circuit in a direction of reducing the voltage across the element immediately before turning ON of the second power converting circuit, and a highly efficient operation can be always realized irrespective of conditions of the load.

14 Claims, 10 Drawing Sheets

DISCHARGE LAMP LIGHTING DEVICE

BACKGROUND OF THE INVENTION

This invention relates to a discharge lamp lighting device and, in particular, to a device for lighting a discharge lamp and including an electronic ballast having a function of improving input current distortion.

DESCRIPTION OF RELATED ART

In an aspect of the discharge lamp lighting device of the kind referred to, the device is provided with a DC power source of which a voltage fluctuates, such as a pulsating flow power source of a commercial AC source power rectified by a full-wave rectifier, and includes a boost converter as a first power converting circuit, a buck converter as a second power converting circuit, and a discharge lamp as a load. In the first power converting circuit, more specifically, an inductor is connected at one end to a positive polarity terminal of the DC power source, and at the other end through a switching element to a negative polarity terminal of the DC power source, and a diode is connected at its anode to a node of the inductor and the switching element, while the cathode of this diode is connected to a positive polarity terminal of a bulk capacitor which is connected at a negative polarity terminal to a positive polarity terminal of the DC power source. The switching element can be ON/OFF controlled by a control circuit. When this switching element is ON, a current flows from the DC power source through the inductor and switching element, and an energy is accumulated in the inductor. When the switching element is OFF, on the other hand, an electromotive force due to the energy accumulated in the inductor is superposed on a voltage of the DC power source and is charged through the diode in the bulk capacitor. On this account, the bulk capacitor is charged up to above a peak voltage of the DC power source. A boost converter as a first power converting circuit is constituted with this arrangement.

The DC voltage of the bulk capacitor is dropped by the buck converter as the second power converting circuit, and is applied to the load discharge lamp. The buck converter represented by an equivalent circuit is connected at one end of the switching element to the ground level to be able to easily drive the switching element. The switching element is connected at one end to the negative polarity terminal of the bulk capacitor and at the other end through the anode and cathode of the diode to the positive polarity terminal of the bulk capacitor An end of the inductor is connected to the anode of the diode. The other end of the inductor is connected through a parallel circuit of a capacitor and the load discharge lamp to the positive polarity terminal of the bulk capacitor.

The switching element of the buck converter is ON/OFF controlled by the control circuit, and this control circuit includes means for detecting a voltage across the switching element. The switching element will be turned ON at a timing at the minimality voltage across the switching element in OFF period of the switching element. One of the discharge lamp lighting devices of this kind has been disclosed in Japanese Patent Application No. 11-117066.

The inductor current is positive direction at the term in which a current acting similar to an ordinary buck converter. The current is negative direction at the other term in which a resonance current for performing a zero volt switching upon turning ON of a main switching element. It is a feature of this device. A charge of parasitic capacitance of the switching element and the capacitor connected in parallel are discharged with this negative directional resonance current. Whereby any short-circuit loss upon turning ON of the switching element can be restrained. The circuit efficiency can be improved in contrast to any known converter of critical continue current mode control (a measure for erasing any quiescent period in the inductor current and restraining any peak current, by turning ON the switching element simultaneously with returning to zero of the inductor current in OFF period of the switching element).

With the foregoing known arrangement, the circuit efficiency can be improved without increasing the number of the switching element more than that in the ordinary buck converter. It is necessary to satisfy predetermined conditions in the relationship between the source voltage and the load voltage. It is impertinence, apply to this arrangement to the discharge lamp lighting device in which the load voltage fluctuates. When in particular this arrangement is employed in current limiting means of a discharge lamp lighting device in which the load is a high luminance discharge lamp, the load voltage fluctuates all the time depending on respective steps of starting and life of the discharge lamp, and it has been considered extremely difficult to keep such optimum conditions.

SUMMARY OF THE INVENTION

An object of the present invention is to provide a discharge lamp lighting device which can overcome the foregoing problem in the known arrangement, and which can constantly realize a highly efficient operation irrespective of conditions of the load, without causing the circuit efficiency to be varied due to any fluctuation in the load, when the device is applied to a discharge lamp lighting device.

Other objects and advantages of the present invention shall become clear as the description advances as detailed with reference to preferred embodiments shown in accompanying drawings.

While the description shall now be made with reference to a plurality of embodiments shown in the accompanying drawings, it should be appreciated that the intention is not to limit the invention only to these embodiments shown but rather to include all alterations, modifications and equivalent arrangements possible within the scope appended claims.

DETAILED DESCRIPTION OF THE PREFERRED EMBODIMENTS

Figure 1:
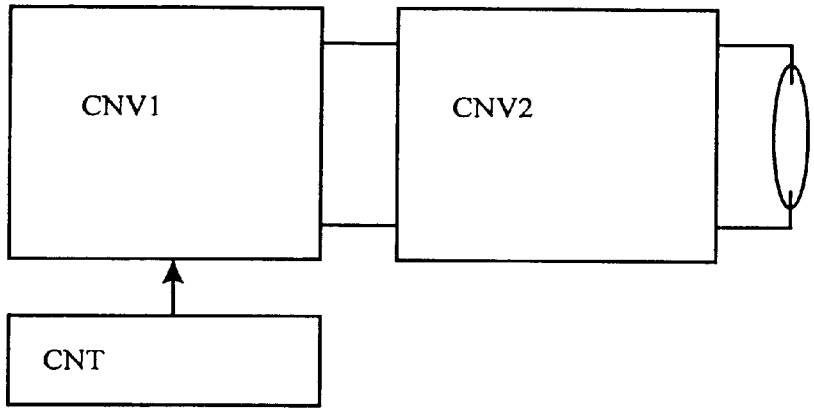
FIG. 1 is a basic block circuit diagram in an embodiment of the discharge lamp lighting device according to the present invention.

A basic circuit diagram in an embodiment of the discharge lamp lighting device according to the present invention is shown in FIG. 1. The discharge lamp lighting device according to the present invention is provided with such first power converting circuit CNV1 as a boost converter. And this first power converting circuit CNV1 is connected to an input power source (not shown) which is likely to cause the load fluctuation to occur. The second power converting circuit CNV2 as the buck converter is connected to this first power converting circuit CNV1. This second power converting circuit CNV2 is connected to such load L of a large impedance fluctuation as a high intensity discharge lamp. An output voltage control circuit CNT capable of regulating the output voltage of this converting circuit is connected to the first power converting circuit CNV1.

Accordingly, it is enabled to realize constantly the highly efficient operation, irrespective of conditions of the load, by regulating, for example, the output voltage of the first power converting circuit toward a reduction of the voltage across the switching element included in the second power converting circuit immediately before turning ON of this switching element.

Figure 2:
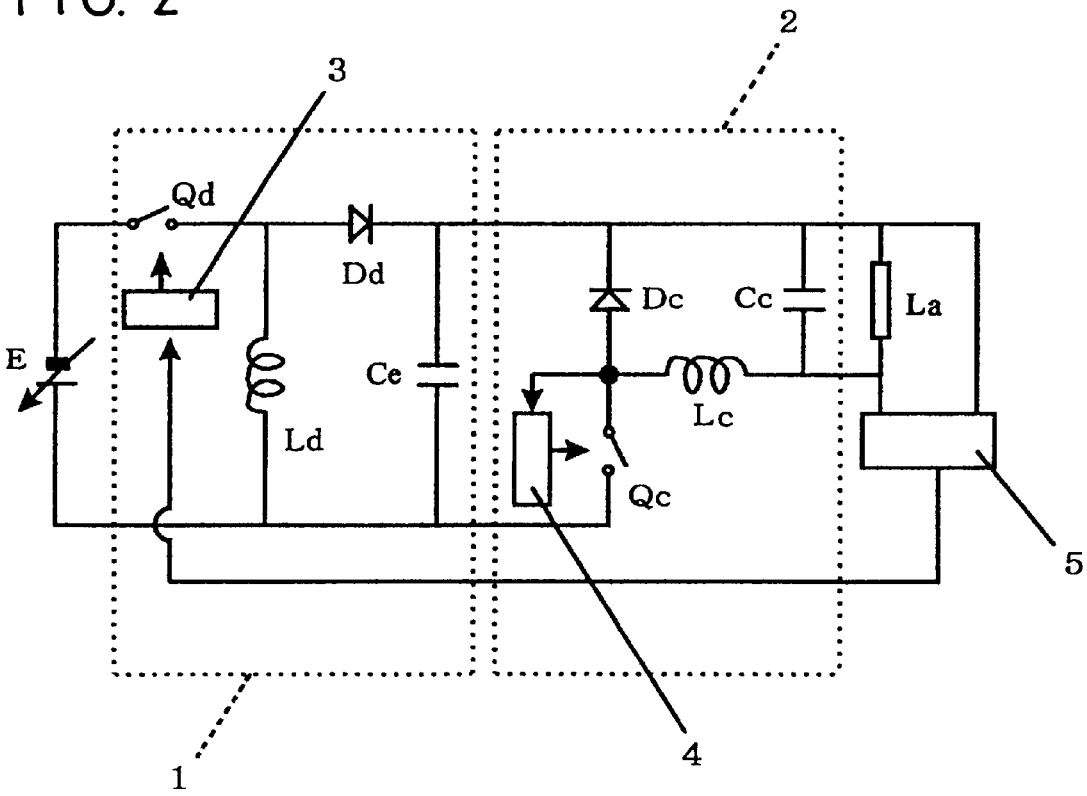
FIG. 2 is a circuit diagram in another embodiment of the device according to the present invention.

In FIG. 2, there is shown a somewhat practical circuit diagram in another embodiment of the discharge lamp lighting device according to the present invention. An inductor Ld is connected at one end to a positive polarity terminal of such DC power source E the voltage of which fluctuates as a pulsating power source obtained by rectifying, for example, a commercial AC source power with a full wave rectifier, and at the other end through a switching element Qd to a negative polarity terminal of the DC power source E. A diode Dd is connected at its anode to a node of the inductor Ld and the switching element Qd, and at the cathode to a positive polarity terminal of a bulk capacitor Ce. And the a negative polarity terminal of the capacitor Ce is connected to the positive polarity terminal of the DC power source E. The switching element Qd is ON/OFF controlled by a control circuit 3. When the switching element Qd is ON, a current flows from the DC power source E through the inductor Ld and switching element Qd to have an energy accumulated in the inductor Ld. As the switching element Qd turns OFF, the bulk capacitor Ce is charged through the diode Dd with an electromotive force due to the accumulated energy in the inductor Ld. With this circuit, a buck boost converter 1 forming the first power converting circuit is constituted.

Further, the DC source power of the bulk capacitor Ce is dropped by means of a buck converter 2 forming the second power converting circuit, and is applied to the discharge lamp La. Another switching element Qc is connected at one end to the negative polarity terminal of the bulk capacitor Ce and at the other end through the anode and cathode of the diode Dc to the positive polarity terminal of the bulk capacitor Ce. A diode Dc is connected at the anode to an end of inductor Lc, and the other end of the inductor Lc is connected, through a parallel circuit of a capacitor Cc and a discharge lamp La to the positive polarity terminal of the bulk capacitor Ce.

The switching element Qc in the buck converter 2 is provided to be ON/OFF controlled by a control circuit 4 which has means for detecting directly or indirectly the voltage across the switching element Qc, and operates to turn the switching element Qc ON at a timing rendering the voltage across the switching element Qc to be the minimality during OFF period of the switching element Qc. In practice, the operation is such that, assuming the capacity across the switching element Qc is C, the inductance value of the inductor Lc is L and their resonating frequency $\tau=2\pi\sqrt{LC}$, the switching element Qc is turned ON after a time t defined by $$n-\tfrac{3}{4}\leq t/\tau\leq n-\tfrac{1}{4}(n=1, 2, 3, \ldots).$$

Figure 3:
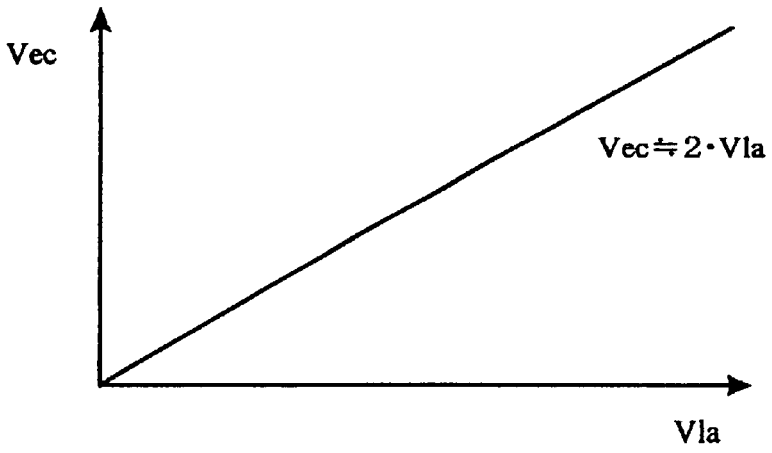
FIGS. 3 and 4 are explanatory diagrams for the operation of the circuit in FIG. 2.
Figure 4A:
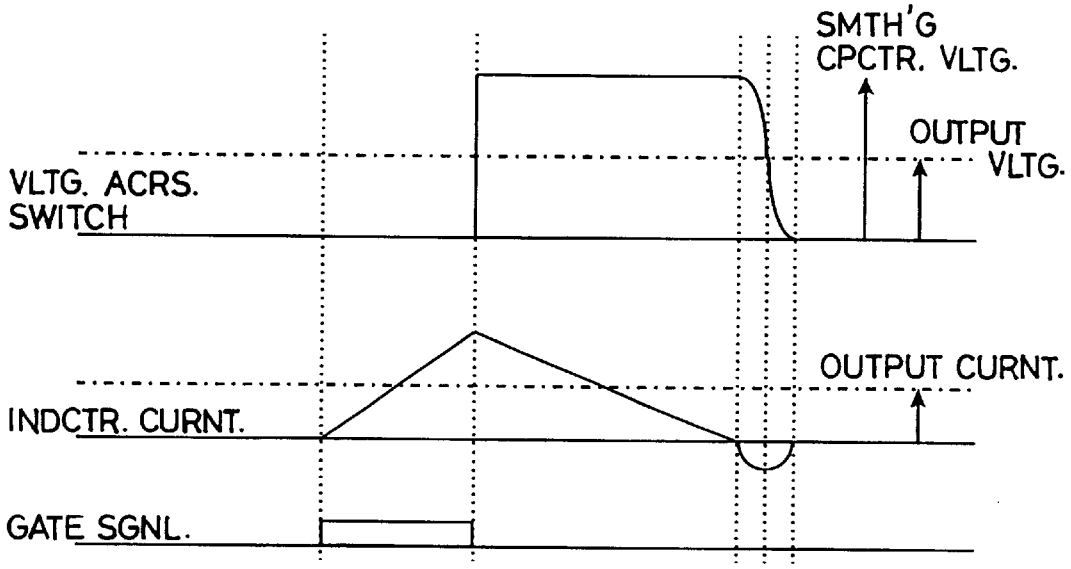
Figure 4B:
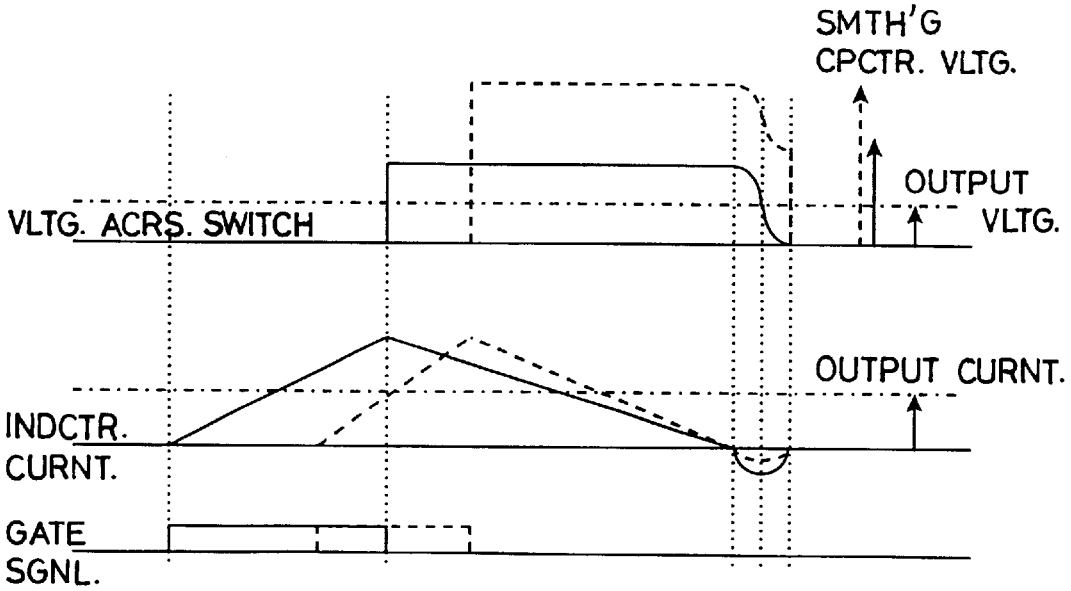

In the present embodiment, there is provided a lamp voltage detecting means 5 for detecting the lamp voltage V1a, and the control is so made that an output voltage Vec of a buck boost converter 1 will be about two time of the lamp voltage Vla (refer to FIG. 3). Further in the present embodiment, a buck boost converter (polarity inverting chopper circuit) 1 is employed as the first power converting circuit, whereby the voltage Vec at the bulk capacitor Ce is made freely controllable to be from a lower voltage to a higher voltage than the voltage of the DC power source E (see FIGS. 4A and 4B, in which FIG. 4A is for a high output voltage, and FIG. 4B is for a low output voltage, broken line curves showing an event where the output voltage Vec is not varied as proposed). A detection output of the lamp voltage detecting means 5 is input into the control circuit 3 as a reference voltage of the buck boost converter 1. The switching element Qd in the buck boost converter 1 is controlled so that the output voltage Vec of the buck boost converter 1 will be about two times as high as the lamp voltage Vla. For the arrangement and operation of the buck converter 2, a buck converter arrangement employing the same zero-volt switching or soft switching technique as the conventional example may be employed. According to the present embodiment, the input voltage Vec of the buck converter 2 can be maintained to be about two times as high as the output voltage Vla as shown in FIG. 3, irrespective of the fluctuation in the lamp voltage Vla in the starting and like steps of the discharge lamp as referred to as the problem in the known device. And the device can be operated so as to render the circuit efficiency of the buck converter 2 to be the maximum.

Figure 5:
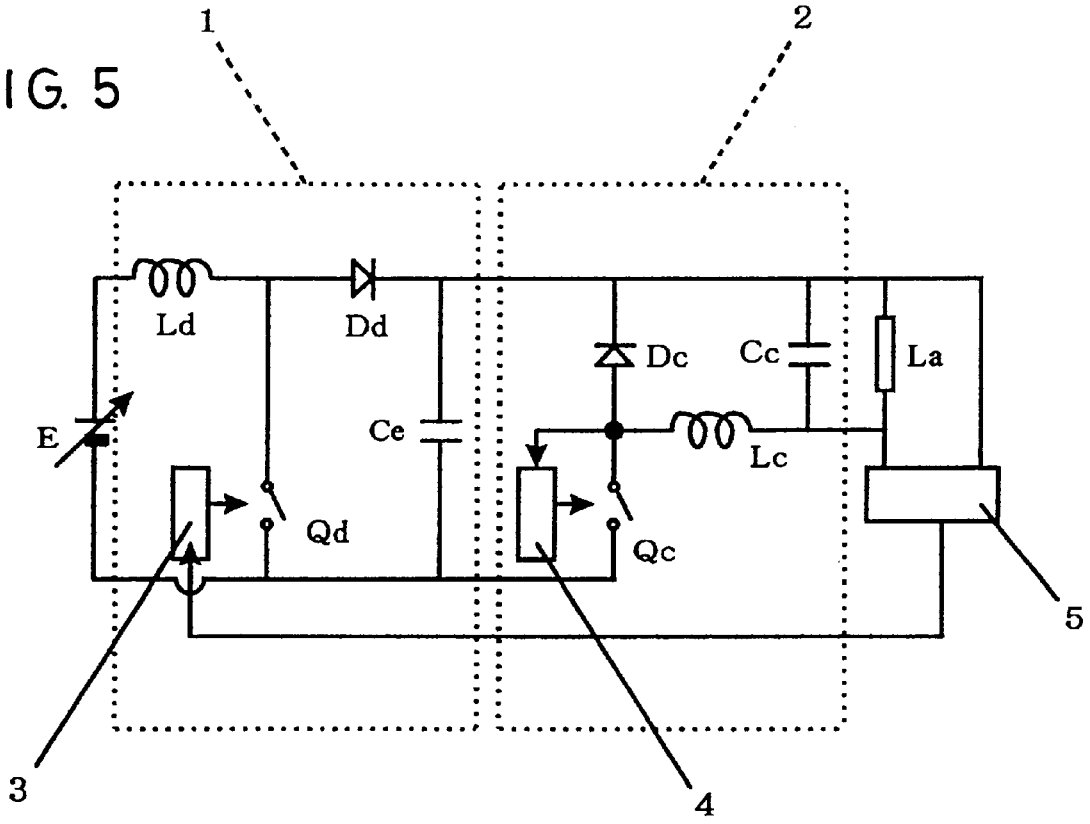
FIG. 5 is a circuit diagram in another embodiment of the device according to the present invention.
Figure 6:
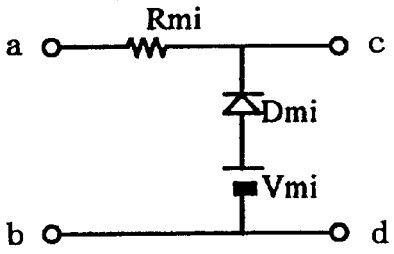
FIG. 6 is a diagram of a circuit for setting lower limit to be employed in the circuit of FIG. 5.

In another embodiment of the present invention as shown in FIG. 5, there is a difference from the embodiment of FIG. 2 in the circuit arrangement of the first power converting circuit and in an addition of a lower limit setting circuit (see FIG. 6). The present embodiment employs as the first power converting circuit the same boost converter as the conventional one, and such lower limit setting circuit as shown in FIG. 6 is provided at an output stage of the lamp voltage detecting means 5, with an arrangement for inputting a detected value of the lamp voltage Vla across terminals a-b and outputting a voltage obtained across terminals c-d as a control command to the first power converting circuit. That is, when the detected value of the lamp voltage Vla is higher than a lower limit value Vmi, a diode Dmi is in OFF state, and the detected value of the lamp voltage Vla across the terminals a-b is output across the terminals c-d through a resistor Rmi. When the detected value of the lamp voltage Vla is lower than the lower limit value Vmi, the diode Dmi turns ON, the detected value of the lamp voltage Vla across the terminals a-b is clamped, and the lower limit Vmi is output across the terminals c-d.

In this case, the first power converting circuit is the boost converter. There is caused a rush current to arise in a loop of the power source E (commercial AC source+full wave rectifier)→inductor Ld→diode Dd→bulk capacitor Ce at crests in the source voltage phase and irrespective of the operation of the switching element Qd forming the converter circuit, by setting the set value of the converter output Vec to be below the maximum value: √2 Vin (rms) of the input voltage Vin from the commercial AC power source. This means that the first power converting circuit is not functioning effectively as the circuit for improving the input current distortion, the inherent object of the present invention.

Figure 7:
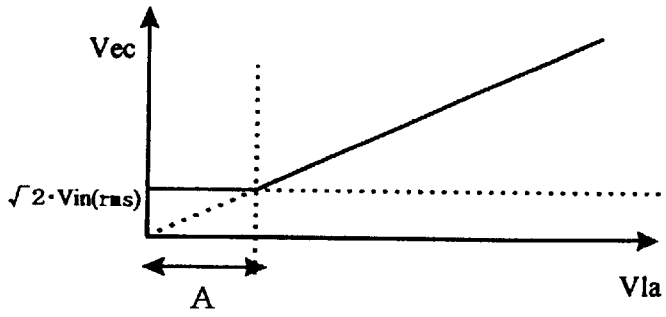
FIG. 7 is an explanatory diagram for the operation of the embodiment in FIG. 5.

Accordingly, the set value of the output voltage Vec of the first power converting circuit is made not to be below the maximum value: √2 Vin (rms) of the input source voltage Vin by means of the foregoing lower limit setting circuit (FIG. 6) of the lamp voltage detecting means 5, whereby it is enabled to attain the operating range at the maximum circuit efficiency of the second power converting circuit to be wide while assuring constantly the power factor improving function. Explaining this with reference to FIG. 7, it is because, while the second power converting circuit cannot attain the maximum circuit efficiency during a low voltage period A in the drawing, the power factor improving function of the first power converting circuit can be secured.

Other arrangements in the embodiment of FIG. 5 are the same as those in the embodiment of FIG. 2, and the same function is attainable.

Figure 8:
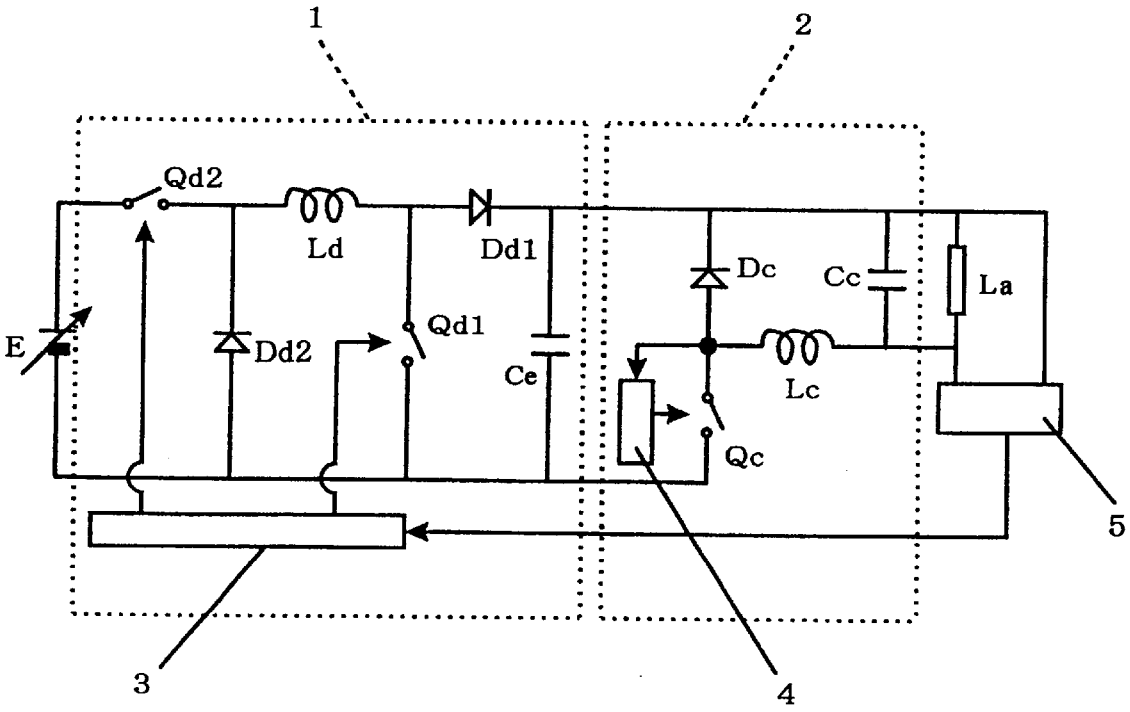
FIG. 8 is a circuit diagram in another embodiment of the device according to the present invention.

In another embodiment of the present invention as shown in FIG. 8, there are differences in the circuit arrangement of the first power converting circuit and in the provision to the control circuit 3 of an operational mode discriminating function. In the present embodiment, a dual-switch buck boost converter is employed as the first power converting circuit. In this circuit, both ends of the DC power source E are connected, through the switching elements Qd1 and Qd2, to both ends of the inductor Ld. The bulk capacitor Ce is connected through a diode Dd1 to both ends of the switching element Qd1. The diode Dd2 is connected in parallel to a series circuit of the switching element Qd2 and DC power source E in a direction opposite to the DC power source E. At this time, the arrangement is enabled to operate as the buck boost converter by simultaneously turning ON and OFF the switching elements Qd1 and Qd2 as shown in FIG. 9A, and to operate as the boost converter by keeping the switching element Qd2 ON and turning the switching element Qd1 ON an OFF as shown in FIG. 9B.

Figure 9A:
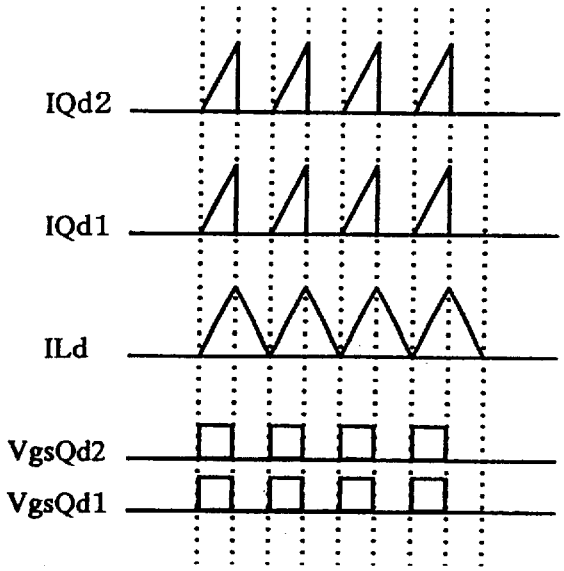
FIGS. 9A and 9B are waveform diagrams for the operation of the circuit in FIG. 8.
Figure 9B:
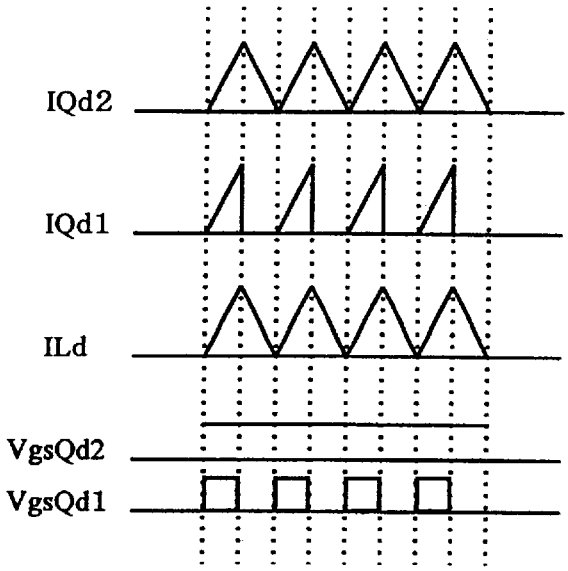

FIGS. 9A and 9B show operational waveforms at respective parts in the dual-switch buck boost converter of FIG. 8. There are shown concurrently a current IQd2 of the switching element Qd2, a current IQd1 of the switching element Qd1, a current ILd of the inductor Ld, a voltage VgsQd2 across the gate and source of the switching element Qd2, and a voltage VgsQd1 across the gate and source of the switching element Qd1.

While in the embodiment of FIG. 8 the use of the buck boost converter 1 provides no restriction to the control range of the output voltage with respect to the input voltage, there is a slight inferiority in the circuit efficiency to the contrary. While on the other hand the boost converter is excellent in the circuit efficiency, it is impossible to output any lower voltage than the input voltage. In the dual-switch buck boost converter of the present embodiment, therefore, it is enabled to switch the operation between those of the buck boost converter and the boost converter by changing the switching mode as in the above.

Figure 10:
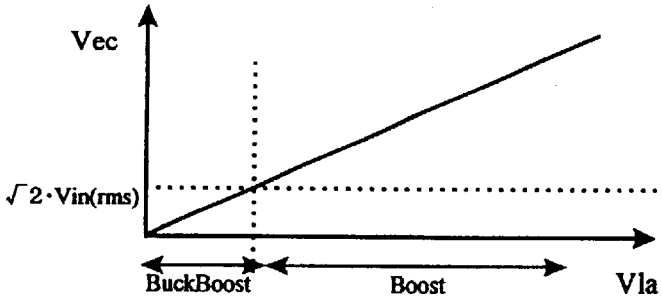
FIG. 10 is an explanatory diagram for the operation of the circuit in FIG. 8.

Further in the present embodiment, the buck boost operation of the dual-switch buck boost converter is attained by means of an operation mode discrimination circuit provided in the control circuit 3, when the lamp voltage Vla detected by the lamp voltage detecting means 5 becomes below ½ of the maximum value; √2 Vin (rms) of the input voltage Vin of the power source E, but its boost operation is attained when the lamp voltage Vla exceeds ½ of the maximum value: √2 Vin (rms) of the input voltage (see FIG. 10). By the way, the maximum value of the input voltage Vin of the power source E is known to be 141 V in AC 100 V and to be 282 V in AC 200 V series, and its detection is unnecessary.

Consequently, it is possible to attain always consistently the function of improving the input current distortion with the first power converting circuit and the maximization of the circuit efficiency with the second power converting circuit, irrespective of the magnitude of the lamp voltage Vla. It is also possible to render always the circuit efficiency of the first power converting circuit to be high. That is, in most part of the operation as the discharge lamp lighting device (in normal lighting state), the first power converting circuit is operating as the boost converter, and the device can operate at a higher efficiency than in the case where the circuit is designed to act only as the buck boost converter consistently from the starting step to the normal lighting state. Further, in general, the lamp power is lower in a range where the lamp voltage is low, and the input power is also lowered. The difference in the circuit efficiency between the boost converter and the buck boost converter is caused to expand as the power converted becomes larger. In a range of low lamp voltages with small converted powers, therefore, any increase in the loss due to the operation in the buck boost mode is less. In this manner, the present embodiment is capable of providing a discharge lamp lighting device of an excellent efficiency, without deteriorating the function demanded.

Other arrangement in the embodiment of FIG. 8 is the same as that in the embodiment of FIG. 2, and the same function can be attained. While in other embodiments of the present invention the same circuit as that in FIG. 2 is employed, the arrangement is so made that, as shown in FIG. 11, means is provided for restraining the output signal of the lamp voltage detecting means 5 in the event when the lamp voltage Vla detected by the means 5 is higher than a fixed value, whereby the output voltage Vec of the first power converting circuit can be restrained from excessively rising, even when the lamp voltage Vla rises in terminating period of the life of the discharge lamp.

Figure 11:
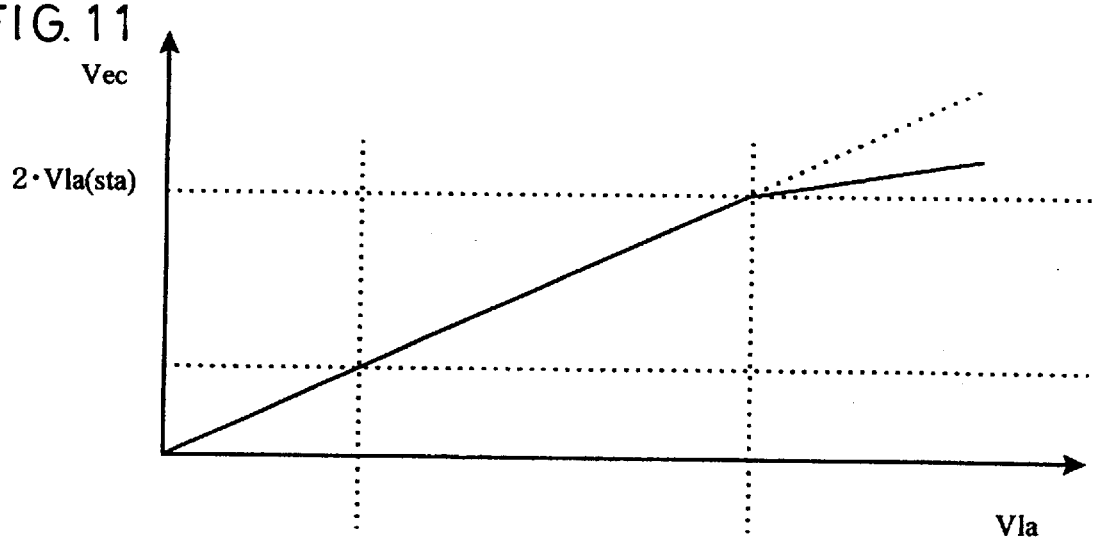
FIG. 11 is an explanatory diagram for the operation of another embodiment of the present invention.

Other arrangement in other embodiments in which the operation shown in FIG. 11 is performed is the same as that in FIG. 2, and the same function can be achieved.

Figure 12:
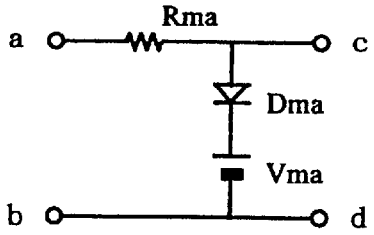
FIG. 12 is a diagram of a circuit for setting upper limit to be employed in another embodiment of the present invention.
Figure 13:
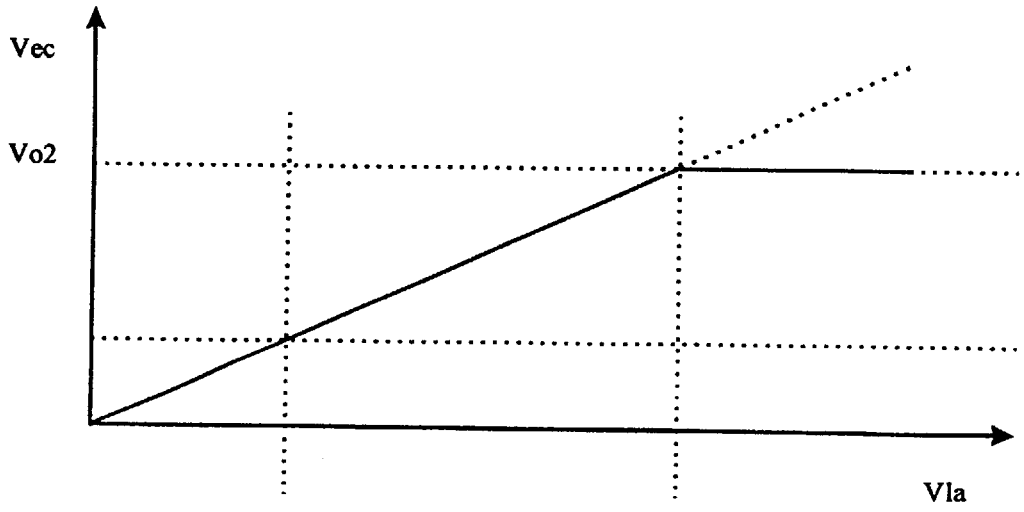
FIG. 13 is an explanatory diagram for the operation of the embodiment in FIG. 12.

In another embodiment of the present invention, such upper limit setting circuit for output signals as shown in FIG. 12 is added to the lamp voltage detecting means 5. This upper limit setting circuit is provided at an output stage of the lamp voltage detecting means 5, the detected value of the lamp voltage Vla is input across the terminals a-b, and a voltage obtained across the terminals c-d is output as a control command for the first power converting circuit. That is, when the detected value of the lamp voltage Vla is lower than the upper limit value Vma, a diode Dma turns OFF, and a detected value of the lamp voltage Vla across the terminals a-b is output through a resistor Rma across the terminals c-d. When the detected value of the lamp voltage Vla is higher than the upper limit value Vma, the diode Dma turns ON, the detected value of the lamp voltage Vla across the terminals a-b is clamped, and the upper limit value Vma is output across the terminals c-d. In the present embodiment, this upper limit setting circuit renders the device to be effective to keep the output voltage Vec of the first power converting circuit not to be more than a voltage Vo2 to activate the discharge lamp (see also FIG. 13).

In the embodiment shown in FIG. 12, other arrangement is the same as FIG. 2, and the same operation can be attained.

Figure 14:
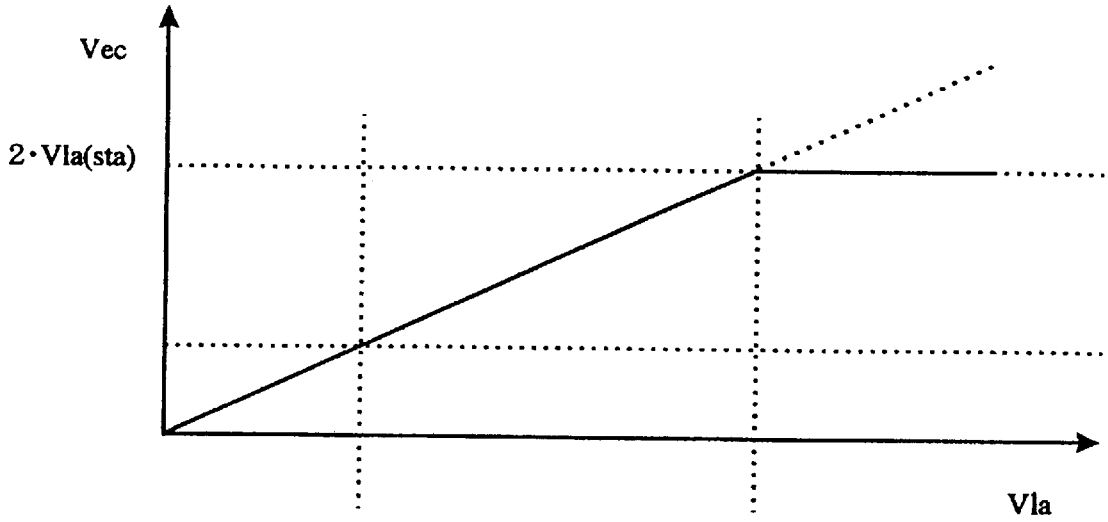
FIG. 14 is an explanatory diagram for the operation in another embodiment.

In another embodiment of the present invention, such upper limit setting circuit for the output signal as shown in FIG. 14 is added to the lamp voltage detecting means 5. In the present embodiment, this upper limit setting circuit arranges the device so that the output voltage Vec of the first power converting circuit will not rise to be more than two times as high as a rated voltage Vla (sta) of the discharge lamp.

In another embodiment performing the operation shown in FIG. 14, other arrangement is the same as that in the embodiment of FIG. 2, and the same operation can be attained.

In the respective embodiments shown in FIGS. 2, 5 and 8, further, it may be possible to insert a full bridge circuit between the discharge lamp La and the second power converting circuit. The full bridge circuit which operates as a low frequency polarity inverting circuit. In this case, a low frequency, square wave voltage is caused to be supplied to the discharge lamp La.

Figure 15:
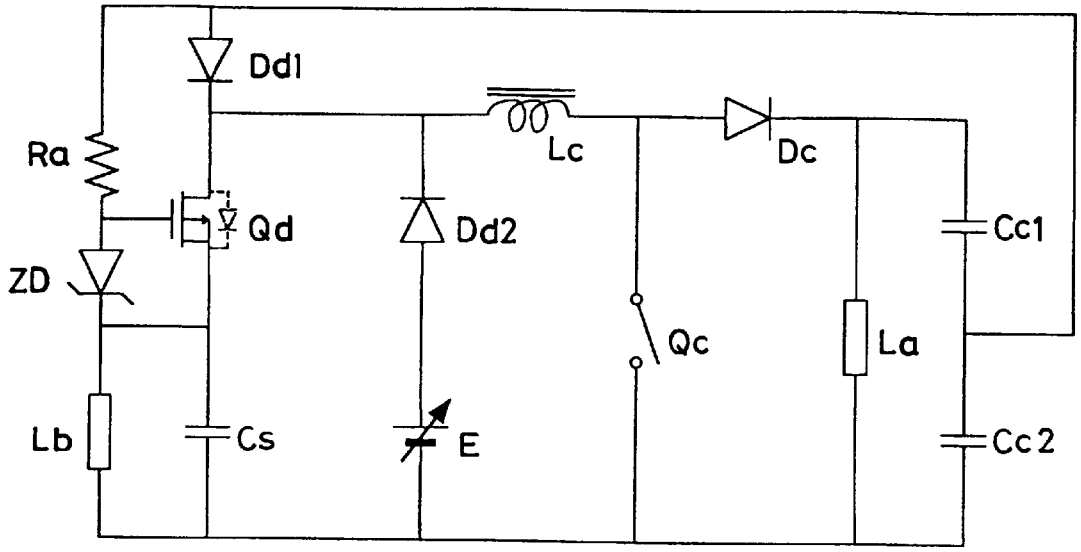
FIG. 15 is a circuit diagram in another embodiment of the present invention.
Figure 16:
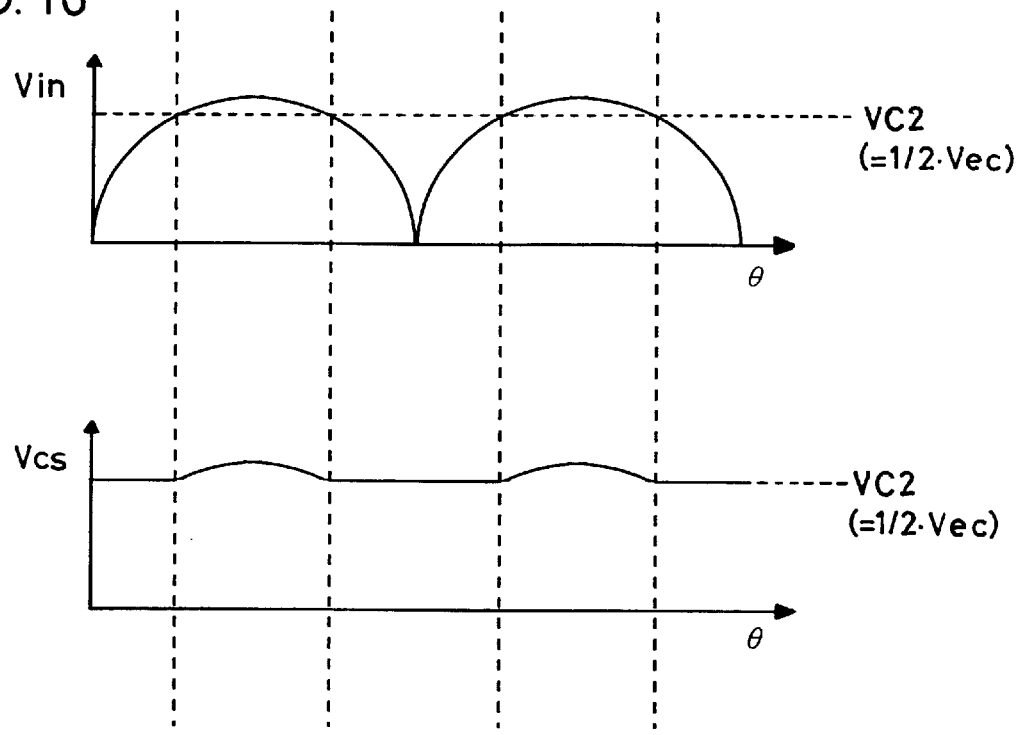
FIG. 16 is an explanatory diagram for the operation in another embodiment of the present invention.

In another embodiment of the present invention shown in FIG. 15, the input power source E is of a pulsating voltage into which the commercial AC source power is full-wave rectified by means of a diode bridge. The diode Dd2 is connected at its anode to the positive polarity terminal of the source, while the cathode of the diode Dd2 is connected to an end of the inductor Lc, and the other end of the inductor Lc is connected through a main switching element Qc to a negative polarity terminal of the source E. Across the main switching element Qc, the load La is connected through a diode Dc and, across the load La, a series circuit of capacitors Cc1 and Cc2 is connected. A diode Dd1 is connected at its anode to a node of the capacitors Cc1 and Cc2, and the node is further connected through a resistor Ra to the gate of an auxiliary switching element Qd, which element comprises a P-channel MOSFET, and a parasitic, inverse directional diode is connected in parallel across the drain and the source. Across the gate and the source of the auxiliary switching element Qd, a Zener diode ZD for over voltage prevention is connected in parallel. The drain of this auxiliary switching element Qd is connected to the cathodes of both diodes Dd1 and Dd2. Between the source of the auxiliary switching element Qd and the negative polarity terminal of the input source E, the capacitor Cs is connected as an auxiliary voltage source. Further, another load Lb is connected in parallel with the capacitor Cs as the auxiliary voltage source. This load Lb will be a power source circuit or the like for actuating a control circuit for the main switching element Qc. Since an energy accumulated in the capacitor Cs as the auxiliary voltage source with a reflux from the inductor Lc in the main circuit is consumed at such other circuit as a controlling power source circuit or the like, the capacitor Cs is never caused to excessively rise in the potential.

Further, in a period in which the full-wave rectified voltage of the input power source E at the crests of the source power phase is higher than a reference potential of the auxiliary voltage source (a potential at the node of the capacitors Cc1 and Cc2), a gate potential of the auxiliary switching element Qd becomes negative with respect to a source potential, and the auxiliary switching element Qd will be bilaterally ON. Therefore, the potential of the auxiliary voltage source in the particular period coincides with the full-wave rectified voltage of the input source power E, so as to be no potential difference between them, and any rush current is avoided from occurring. At valleys in the source power phase, on the other hand, the capacitor Cs is charged through the diode Dd1 in the period in which the full-wave rectified voltage of the input voltage E is lower than the reference potential of the auxiliary voltage source, so that the voltage of the auxiliary voltage source will be restrained from becoming lower than the reference potential.

It is possible to replace the first power converting circuit in the discharge lamp lighting device shown in FIG. 5 with the boost converter of the arrangement as in the above. As the thus replacing boost converter performs a soft switching operation, the efficiency is elevated in contrast to a conventional boost converter. Further, as it is possible to retain the high efficiency even with respect to the source voltage fluctuation, the discharge lamp lighting device according to the present embodiment is an optimum example which can realize constantly the optimum circuit efficiency, irrespective of the fluctuation in the input and lamp voltages.

In the discharge lamp lighting device as shown in FIG. 2, the circuit efficiency can be improved by turning ON the switching element Qd also in the first power converting circuit at a timing when the voltage across the element becomes the minimality, similar to the foregoing second power converting circuit. At this time, however, the voltage of the source power E is varying all the time as being the full-wave rectified voltage of the commercial source power.

Because of the similar principle, the circuit efficiency of the particular power converting circuit becomes the maximum at the time when the voltage Vec of the bulk capacitor will be two times as high as that of an absolute value at a momentary value of the source voltage Vin. A resonating current for rendering it to be zero-volt flows through a loop of the switching element Qd (its output capacity)→inductor Ld→power source E, upon which an initial value of the switching element Qd is the bulk capacitor voltage Vec. Due to this, there has been a problem that the resonance current in negative direction becomes excessive when the absolute value at the momentary value of the input current at positions adjacent to zero-cross points becomes lower than ½ of the bulk capacitor voltage Vec, ON period of the switching element Qd is shortened seemingly, so that the input current at positions adjacent to the zero-cross points of the source voltage will be reduced and the input current distortion will be increased.

In the present embodiment, however, there is present the capacitor Cs the voltage of which is always more than ½ of the bulk capacitor voltage Vec to be in parallel with the source voltage. In the event where the moment value of the source voltage is more than ½ of the bulk capacitor voltage Vec, there occurs a resonating current for attaining the zero-volt, similar to that in the known device. In an event when the momentary value of the source voltage becomes less than ½ of the bulk capacitor voltage Vec, the resonating current for attaining the zero-volt flows through a loop of the switching element Qd (output capacity thereof)→inductor Ld→switching element Qc→capacitor Cs (of FIG. 15), upon which the voltage across the capacitor Cs is ½ of the bulk capacitor voltage Vec, so as to be the optimum resonating current, as a result of which the switching element Qc is capable of maintaining its zero-cross operation even at the points adjacent to the zero-cross of the source voltage and of restraining the reduction in the input current.

Figure 17:
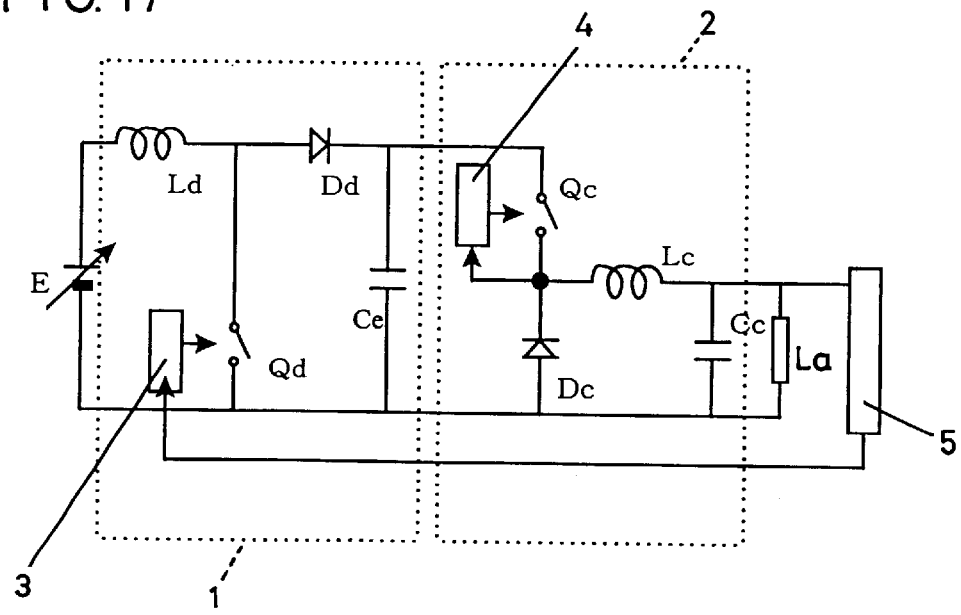
FIGS. 17 to 20 are respectively circuit diagrams of other embodiments of the present invention.

In another embodiment of the present invention as shown in FIG. 17, in contrast to the foregoing embodiment of FIG. 5, one end of the switching element Qc in the buck converter 2 is connected to a node of the cathode of the diode Dd and one end of the bulk capacitor Ce, and the other end of the bulk capacitor Ce is connected to the diode Dc, capacitor Cc for the discharge lamp load and this load La. Other arrangement of the embodiment of FIG. 17 is the same as that in the embodiment of FIG. 5, and the same operation as in the embodiment of FIG. 5 is attained.

Figure 18:
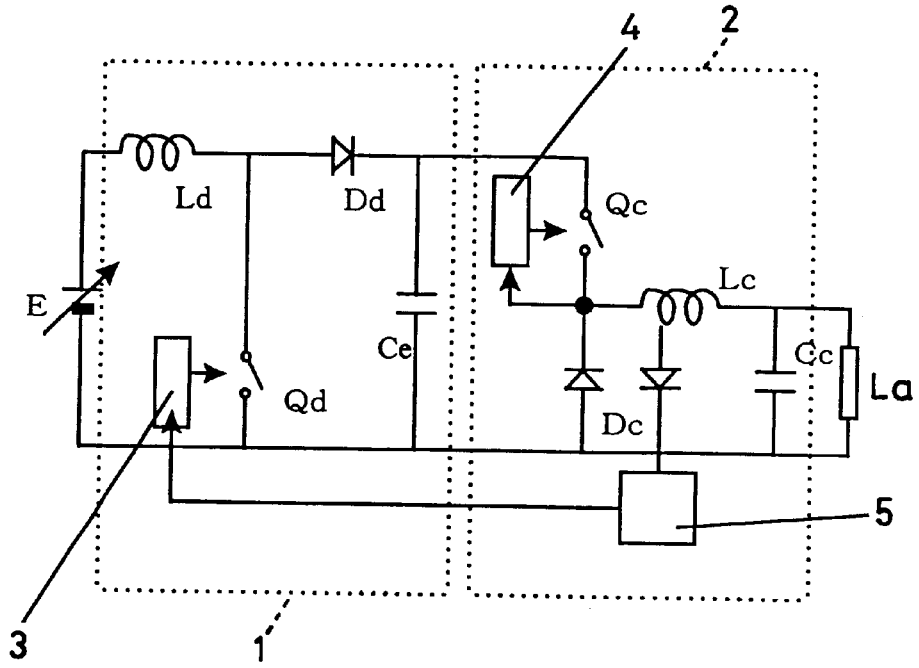

In another embodiment shown in FIG. 18, in contrast to the embodiment of FIG. 17, the inductor Lc in the buck converter 2 is provided with an intermediate tap to which the lamp voltage detecting means 5 is connected through a diode, and a detection signal from this tap is provided to the control circuit 3 of the boost converter 1. With this arrangement, the control of the switching element Qd can be made further excellent by means of the control circuit 3 of the boost converter 1. Other arrangement in the embodiment of FIG. 18 as well as the operation thereof are the same as those in the embodiment shown in FIG. 5 or 17.

Figure 19:
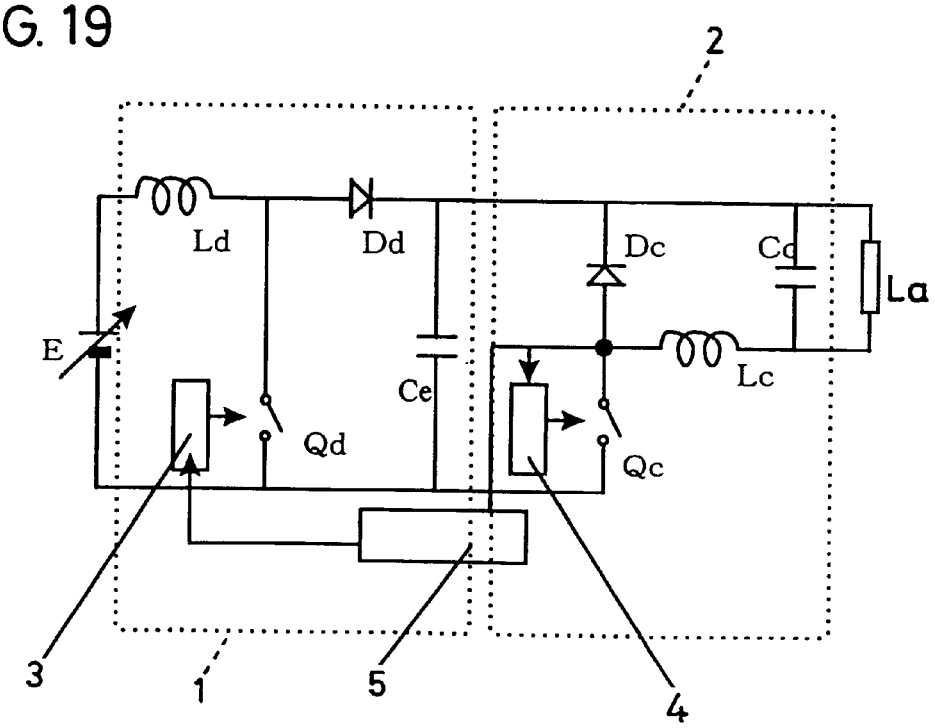

In another embodiment in FIG. 19 of the present invention, in contrast to the embodiment of FIG. 18, the lamp voltage detecting means 5 is connected to a node of the switching element Qc, anode of the diode Dc and inductor Lc, so that a detection signal at this point is provided to the control circuit 3, and the same signal as that to the control circuit 4 in the back converter 2 is provided to the control circuit 3. Other arrangement and operation of the embodiment of FIG. 19 are the same as those in the embodiments of FIG. 5 or 17.

Figure 20:
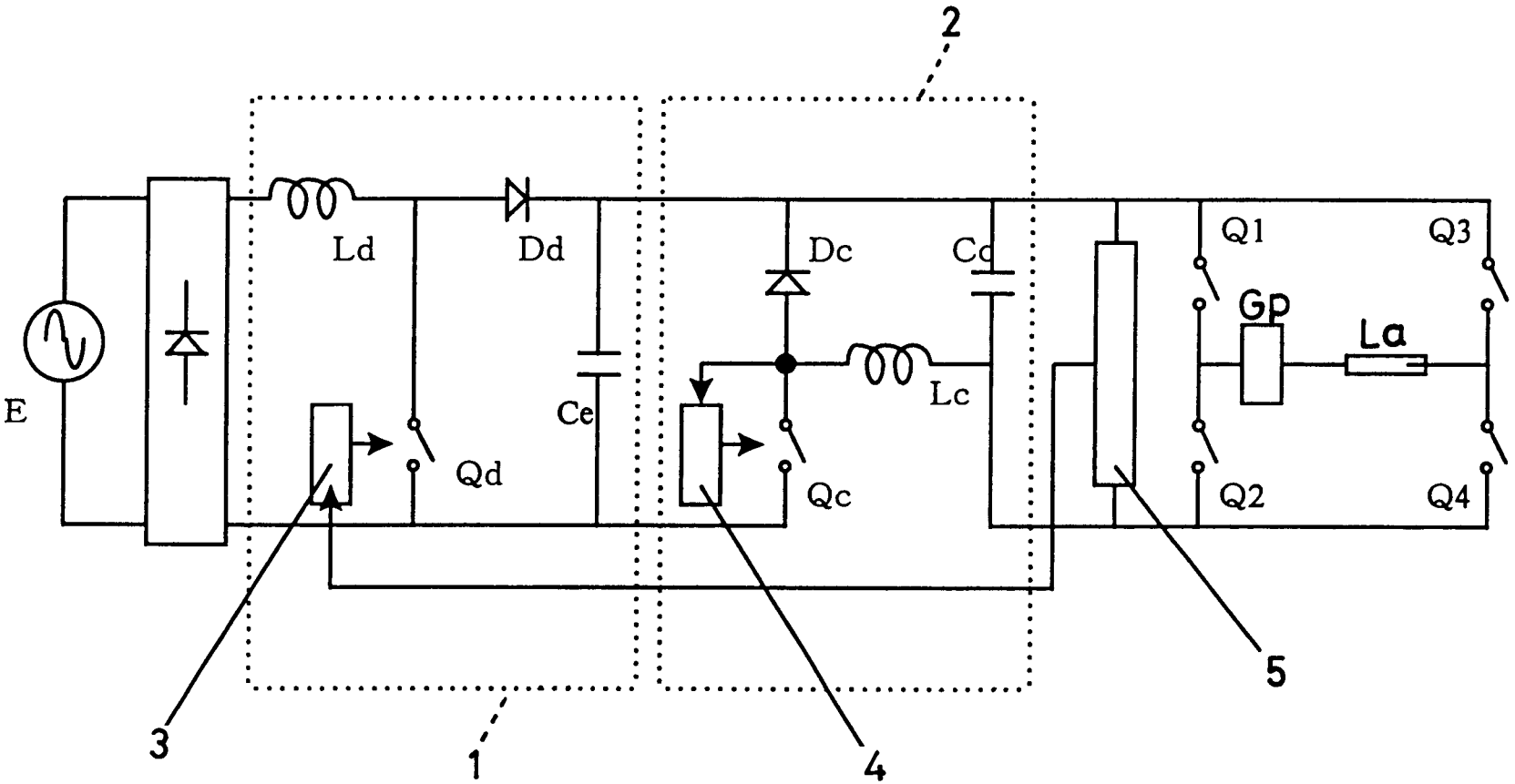

In another embodiment shown in FIG. 20 of the present invention, the lamp voltage detecting means 5 and the discharge lamp load circuit are connected across the output ends of the buck converter 2. In this case, the load circuit includes switching elements Q1–Q4, and a series circuit of a starting pulse generator Gp and the load La is connected between a node of the switching elements Q1 and Q2 and a node of the switching elements Q3 and Q4. In these switching elements Q1–Q4, the elements Q1 and Q4 and the elements Q2 and Q3 are respectively alternately turned ON and OFF. This embodiment finds its utility when actuated with a square wave low frequency. Other arrangement and operation are the same as those in the embodiments of FIG. 5 or 7.

What is claimed is:

1. A discharge lamp lighting device comprising first power converting circuit for converting an input source power voltage into another DC voltage, second power converting circuit having a buck converter which includes at least a switching element, a control means for controlling an output voltage of the first power converting circuit toward a reduction of a voltage across the switching element immediately before turning ON of the element in the second power converting circuit, and a discharge lamp driven by an output voltage of the second power converting circuit.

2. A discharge lamp lighting device comprising first power converting circuit for converting an input source power voltage into another DC voltage, second power converting circuit having a buck converter which includes at least a switching element, a control means for controlling an output voltage of the first power converting circuit toward a reduction of a voltage across the switching element immediately before turning ON of the element in the second power converting circuit, a discharge lamp driven by an output voltage of the second power converting circuit, and a lamp voltage detecting means connected across the discharge lamp to detect a lamp voltage and to provide the lamp voltage detected to the control means as a reference voltage for the first power converting circuit, wherein the control means is provided for setting the output voltage of the first power converting circuit to be between 1.5 time and 2.5 times as high as the lamp voltage detected of the discharge lamp being lighted.

3. The device according to claim 2 wherein the minimum value of the output voltage of the first power converting circuit is set to be at a higher value than the maximum value of an input voltage of the first power converting circuit.

4. The device according to claim 2 wherein the first power converting circuit is operated in a buck boost mode when the output setpoint of the first power converting circuit has become lower than the maximum input voltage value, but in a boost converter mode when the output setpoint of the first power converting circuit has become higher than the maximum input voltage value.

5. The device according to claim 2 wherein the maximum value of the output voltage of the first power converting circuit is set to be at a voltage to activate the discharge lamp.

6. The device according to claim 2 wherein the maximum value of the output voltage of the first power converting circuit is set to be between 1.5 times and 2.5 times as high as a rated lamp voltage.

7. The device according to claim 2 wherein the first power converting circuit comprises a series circuit of an inductor and a switching element and connected to an input DC power source, and a buck boost converter including a bulk capacitor connected through a diode to both ends of the inductor.

8. The device according to claim 2 which further comprises a full bridge circuit inserted at front stage of the discharge lamp.

9. A discharge lamp lighting device comprising first power converting circuit for converting an input source power voltage into another DC voltage, second power converting circuit having a buck converter which includes at least a switching element, a control means for controlling an output voltage of the first power converting circuit toward a reduction of a voltage across the switching element immediately before turning ON of the element in the second power converting circuit, and a discharge lamp driven by an output voltage of the second power converting circuit, wherein the first power converting circuit is formed by connecting positive and negative polarity terminals of a DC power source through first and second switching elements to both ends of an inductor, connecting first diode in parallel to a series circuit of the first switching element and the DC power source in opposite direction to the DC power source, and connecting a bulk capacitor through second diode across the second switching element, whereby the first power converting circuit being operated as a boost converter with the first switching element kept in ON state and with the second switching element turned ON and OFF, and as a buck boost converter with both switching elements turned ON and OFF as synchronized.

10. A discharge lamp lighting device comprising a rectifier for rectifying an input voltage from an AC power source, a boost converter for boosting an output voltage of the rectifier, a buck converter for dropping an output voltage of the boost converter, control means for controlling the output voltage of the boost converter toward a reduction of a voltage across a switching element in the buck converter immediately before turning ON of the switching element so that the switching element turns ON at a timing when the voltage across the switching element becomes the minimality, and a discharge lamp driven by an output voltage of the buck converter.

11. A discharge lamp lighting device comprising first power converting circuit for converting an input source power voltage into another DC voltage, second power converting circuit having a buck converter which includes at least a switching element, a control means for controlling an output voltage of the first power converting circuit toward a reduction of a voltage across the switching element immediately before turning ON of the element in the second power converting circuit, and a discharge lamp driven by an output voltage of the second power converting circuit; the first power converting circuit being formed by connecting positive and negative polarity terminals of a DC power source through first and second switching elements to both ends of an inductor, connecting first diode in parallel to a series circuit of the first switching element and the DC power source in opposite direction to the DC power source, and connecting a bulk capacitor through second diode across the second switching element, whereby the first power converting circuit being operated as a boost converter with the first switching element kept in ON state and with the second switching element turned ON and OFF, and as a buck boost converter with both switching elements turned ON and OFF as synchronized; wherein the input source voltage is a pulsating voltage, the second power converting circuit includes an auxiliary voltage source, the first and second power converting circuits being arranged for a flow of a first inductor current of an inverse polarity to a second inductor current which flows when the switching element turns ON, through a closed loop of at least the auxiliary voltage source, switching element and inductor; the device further comprises means for comparing the input source voltage with a predetermined voltage set to be adjacent to ½ of an output voltage of the boost convert, and means for rendering a potential of the auxiliary voltage source to be substantially coincidence with a potential of the input source voltage when the input source voltage is higher in the instantaneous value of the pulsating voltage than the predetermined voltage.

12. A discharge lamp lighting device comprising first power converting circuit for converting an input source power voltage, second power converting circuit having a buck converter which includes at least a switching element, a control means for controlling an output voltag of the first power converting circuit toward a reduction of a voltage across the switching element immediately before turning ON of the element in the second power converting circuit, and a discharge lamp driven by an output voltage of the second power converting circuit, wherein the second power converting circuit further includes an inductor and is controlled for turning ON the switching element after a time defined by $$n-\tfrac{3}{4} \leq t/\tau \leq n-\tfrac{1}{4} (n=1, 2, 3. . . )$$

from the time when the inductor current is made zero, wherein r denotes a resonance cycle caused by the capacity across the switching element from a time when the inductor current is zero.

13. A discharge lamp lighting device comprising a boost converter receiving an input pulsating voltage from a DC power source and including at least a switching element, an inductor and a rectifying element; means for detecting a voltage across the switching element; means for controlling the switching element so as to turn ON the element at a timing when the voltage across the element becomes the minimum during ON period of the element; at least an auxiliary voltage source for causing a first inductor current of inverse polarity to a second inductor current flowing upon turning ON of the switching element to flow through a closed loop including at least the auxiliary voltage source, switching element and inductor upon turning OFF of the element; means for comparing the input pulsating voltage with a predetermined voltage set at a value adjacent to ½ of an output voltage of the boost converter; and means for rendering a potential of the auxiliary voltage source to be substantially coincidence with that of the input pulsating voltage when the input pulsating voltage is higher in the instantaneous value than the predetermined value.

14. A discharge lamp lighting device comprising a boost converter receiving an input pulsating voltage form a DC power source and including at least a switching element, an inductor and a rectifying element; means for detecting a voltage across the switching element; means for controlling the switching element so as to turn ON the element at a timing when the voltage across the element becomes the minimum during ON period of the element; at least an auxiliary voltage source arranged for a flow of a first inductor current of an inverse polarity to a second inductor current which flows when the switching element turns ON, through a closed loop of at lest the auxiliary voltage source, switching element and inductor; means for comparing the input pulsating voltage with predetermined voltage set to be adjacent to ½ of an output voltage of the boost converter; and means for rendering a potential of the auxiliary voltage source to be substantially coincidence with potential of the input pulsating voltage when the input pulsating voltage is higher in the instantaneous value of the pulsating than the predetermined voltage.

* * * * *